United States Patent [19]

Mackarvich

[11] 4,310,090

[45] Jan. 12, 1982

[54] NESTABLE TIE DOWN ANCHOR AND PACKAGE THEREOF

[76] Inventor: Charles J. Mackarvich, 8511 NW. 61st St., Miami, Fla. 33166

[21] Appl. No.: 183,447

[22] Filed: Sep. 2, 1980

[51] Int. Cl.[3] ..... B65D 85/20; B65D 85/62; B65D 71/00

[52] U.S. Cl. ..... 206/443; 206/343; 52/157

[58] Field of Search ..... 206/443, 230, 343, 342; 52/157

[56] References Cited

U.S. PATENT DOCUMENTS

| | | | |
|---|---|---|---|
| 1,046,665 | 12/1912 | Smith | 206/342 |
| 2,283,308 | 3/1940 | Bean . | |
| 2,559,732 | 2/1948 | Padgett . | |
| 2,940,081 | 6/1960 | Juilfs | 206/343 |
| 3,057,472 | 10/1962 | Douty | 206/342 |
| 3,283,893 | 11/1964 | Durocher et al. . | |
| 3,861,526 | 1/1975 | Leistner | 206/343 |

OTHER PUBLICATIONS

Brochure entitled "Engineered to Hang in There"–Tie Down Engineering, Miami, Florida.

*Primary Examiner*—William T. Dixson, Jr.
*Attorney, Agent, or Firm*—Schwartz, Jeffery, Schwaab, Mack, Blumenthal & Koch

[57] ABSTRACT

A stably nestable tie down anchor comprising a pointed shaft with an auger blade at the pointed end and a U-shaped head at the other end with recesses formed in the end faces of the U-shaped head for receiving the shaft of an adjacently positioned anchor; said anchors being stably nestable by arranging a plurality thereof in head to toe relation with the shaft of each one adjacent the auger blade thereof received in one of the recesses in the head of the next adjacent anchor and vice versa and with the radially facing end faces of the heads of alternate anchors stably engaging each other and the auger blades of alternate anchors nested with each other; and a stable package of anchors formed by strapping together a group of nested anchors.

38 Claims, 3 Drawing Figures

NESTABLE TIE DOWN ANCHOR AND PACKAGE THEREOF

FIELD OF THE INVENTION

This invention relates to tie down anchors. More particularly, this invention relates to an irregularly shaped, stably nestable tie down anchor. Specifically, the present invention relates to a tie down anchor which can be stably packaged with a minimum of extraneous packaging material by nesting the anchors with each other and securing them together with a strap or the like.

BACKGROUND OF THE INVENTION

Tie down anchors are used to provide stable anchoring points for tying down house trailers, aircraft, large tents and similar objects or nonpermanent structures to prevent them from being moved from a desired location, and possibly damaged, by wind, etc. One end of the anchor is twisted into the earth and then a strap or cable connected to the object to be secured is fastened to the other end of the anchor. Typically, such anchors have irregular, unsymmetrical shapes. One preferred form of anchor which is highly effective and which can be economically manufactured comprises a shaft with a helical auger blade secured to one end and a head or mounting bracket at the other end to which a cable or strap may be fastened.

Packaging such irregularly shaped articles for transportion or storge poses problems. Heretofore, anchors of the described type have been mounted in sets in wooden frames for storage or shipment. Preparation of the frames and mounting of the anchors therein is time consuming and expensive. Moreover, the frames themselves add weight and take up space which increases shipping and storage costs.

Symmetrical articles such as pipes are often packaged by strapping them together in bundles (see U.S. Pat. No. 3,283,893). Attempts have also been made to bundle tie down anchors directly to each other in sets, but because of the irregular shape of each anchor, only loose bundles of the anchors have been produced. This approach has been found unsatisfactory because, with the individual anchors free to slide with respect to each other, the bundles are extremely awkward to handle.

It would be desirable if the anchors, despite their generally irregular shape, could be nested to form a stable unit. Heretofore, the only stably nestable anchors have taken the form of helical coils (see U.S. Pat. No. 2,559,732).

OBJECTS OF THE INVENTION

Accordingly, it is an object of the present invention to provide a tie down anchor which, despite its irregular shape, is stably nestable with other such anchors.

Another object of the present invention is to provide a tie down anchor which can be readily packaged as a stable unit.

A further object of the present invention is to provide a tie down anchor which can be packaged with a minimum of extraneous packaging material.

It is also an object of the present invention to provide a tie down anchor which can rapidly and efficiently be packaged at a low cost.

Yet another object of the invention is to provide a tie down anchor which when packaged is less expensive to transport or store.

A still further object of the present invention is to provide a package of stably nested tie down anchors.

SUMMARY OF THE INVENTION

These and other objects of the invention are achieved by providing a stably nestable tie down anchor comprising shaft means, auger blade means secured to said shaft means adjacent one end thereof and head means secured to the other end of said shaft means, and head means being provided with at least one recess for receiving the shaft means of a second tie down anchor and having at least one radially facing surface for stably engaging the head means of a third tie down anchor, said recess being formed in said radially facing surface of said head means.

The objects of the invention are further achieved by providing a package of tie down anchors comprising a plurality of individual tie down anchors each comprising shaft means, auger blade means secured to said shaft means adjacent one end thereof and head means secured to the other end of said shaft means, said anchors being assembled in interlocking, nesting relation alongside each other with the shaft means of each anchor adjacent the auger blade means thereof being received in a recess formed in the head means of an adjacent anchor, and said package further comprising strap means for holding said nested anchors in position with respect to each other.

BRIEF DESCRIPTION OF THE DRAWINGS

The invention will be explained in further detail with reference to the accompanying drawings wherein.

DETAILED DESCRIPTION OF PREFERRED EMBODIMENTS

Figure 1:
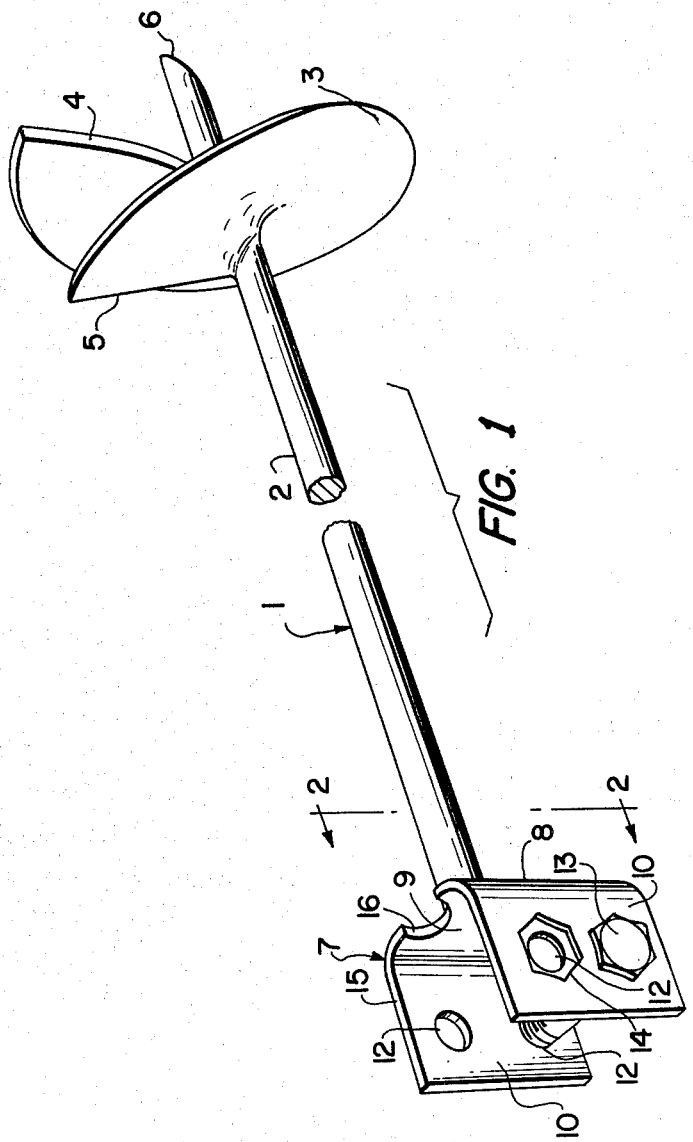
FIG. 1 is a perspective view of a stably nestable tie down anchor according to the present invention.

FIG. 1 is a perspective view of a preferred tie down anchor generally designated by reference numeral 1 comprising shaft means 2, auger blade means 3 and head means 7. Shaft 2 generally comprises a steel rod, the length and diameter of which will vary somewhat depending upon soil conditions. Generally rod diameters from about ½ inch to about 1 inch are useful. High tensile strength steels may be utilized.

Auger blade means 3 is formed from a circular steel plate having a central aperture corresponding to the diameter of the rod and a radial split extending from the aperture to the outer periphery of the plate. The split plate is twisted to a helical configuration, as shown, and welded to shaft 2. Desirably, the leading edge 4 and trailing edge 5 of auger blade means 3 are sharpened to facilitate movement of the auger blade through the earth as the anchor is twisted into, or out of, the ground. The end of shaft 2 adjacent auger blade means 3 is provided with a point 6 by cutting off the shaft at an angle with respect to the axis thereof.

Head means 7 comprises a U-shaped body 8 having a bottom portion 9 and projecting arms 10. A hole 11 is formed in bottom 9 of head means 7 which corresponds in diameter to shaft 2, and body 8 is secured to the shaft by inserting the shaft in the hole and welding the two pieces together. Of course, other types of heads, besides the described U-shaped head, could be utilized.

Two pairs of aligned apertures 12 are formed through the arms 10 of body 8 adapted to receive mounting bolts 13 for tie down cables or straps. If desired, polygonal depressions 14 corresponding in shape to the polygonal heads of bolts 13 may be formed in the outer wall of arm 10 around each aperture 12. Typically the mounting bolt heads 13 and the depressions 14 will be hexagonal in shape, as shown, but other configurations could be utilized as well. When the bolts are slightly loose, they can be turned to apply tension to the tie down strap or cable. When the desired tension on the cable or strap has been achieved, the bolt is held in place while the nut is tightened. Tightening the nut draws the head of the bolt into the depression until it is firmly engaged by the mating depression, thereby preventing rotation of the bolt and maintaining tension on the cable or strap.

In the illustrated embodiment, head 7 is eccentrically positioned with respect to shaft 2 so that one of the pairs of apertures 12 is aligned with shaft 2. This arrangement makes it possible, if desired, to use only a single mounting bolt 13 to fasten a tie down strap or cable to the anchor without applying a torsional stress to the head of the anchor. Of course, it is possible to use anchor heads which are symmetrically positioned or which contain only a single pair of aligned apertures 12.

The ends of arms 10 and bottom 9 of body 8 define radially facing end faces 15 of head means 7, and in each end face, a recess 16 is formed. Each recess 16 is adapted to receive the shaft 2 of an adjacently disposed anchor when a plurality of the anchors are nested as described hereinafter. The recesses may be more clearly seen from FIG. 2.

Figure 2:
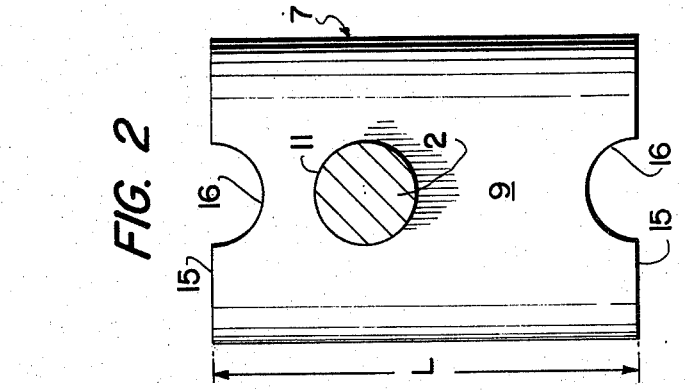
FIG. 2 is a sectional view of the anchor of FIG. 1 taken along line 2—2 showing the bottom plan of the head means of the anchor.
Figure 3:
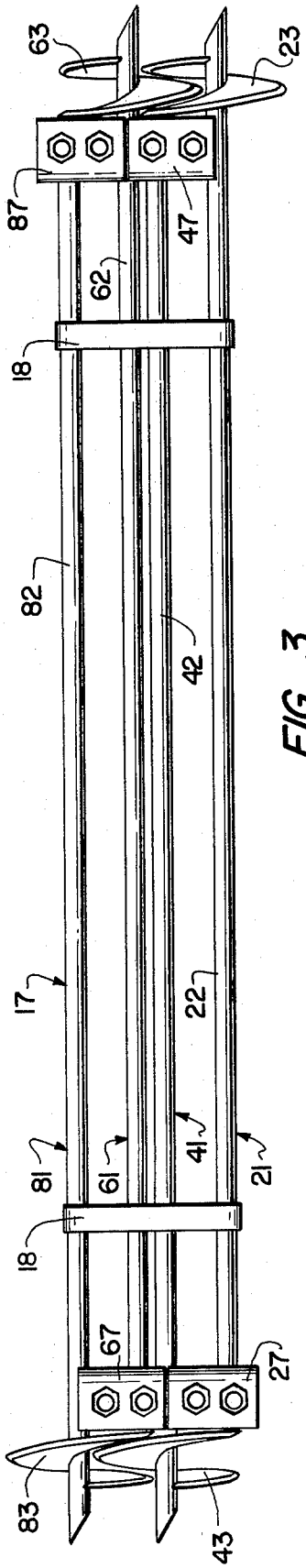
FIG. 3 is a plan view of a package of four stably nested anchors.

FIG. 3 shows a stable package 17 of four nested tie down anchors designated respectively by reference numerals 21, 41, 61 and 81, each of which corresponds in form to anchor 1 of FIGS. 1 and 2. Anchor 21 comprises shaft 22, auger blade means 23 and head means 27. Anchor 21 is placed alongside anchor 41 in head to toe relation therewith so that anchor shafts 22 and 42 are generally parallel. Shaft 42 of anchor 41 adjacent the auger blade means 43 thereof is received in the recess in one of the end faces of head means 27 of anchor 21, and shaft 22 of anchor 21 adjacent auger blade 23 thereof is received in the corresponding recess in one of the end faces of head means 47 of anchor 41.

A third anchor 61 is placed alongside anchor 41 in head to toe relation therewith on the opposite side from anchor 21. Anchor 61 is thus oriented similarly to anchor 21. Shaft 62 of anchor 61 is received in the recess in the other radially facing end face of head means 47 of anchor 41. Auger blade means 63 of anchor 61 nests with the auger blade means 23 of anchor 21, and one end face of head means 67 of anchor 61 is aligned with and engages the adjacent end face of head means 27 of anchor 21. The recesses in the engaging end faces of head means 27 and head means 67 mate to form a circular opening through which shaft 42 of anchor 41 passes. Desirably, the depth of each of the recesses is substantially the same as the radius of the shaft received therein so that shaft 42 is firmly clamped between head means 27 and 67.

A fourth anchor 81, comprising shaft 82, auger blade means 83 and head means 87, is placed alongside anchor 61 in head to toe relation therewith with shaft 82 generally parallel the shafts of the other anchors. Anchor 81 is thus oriented similarly to anchor 41. Shaft 82 adjacent auger blade means 83 is received in the recess in the other end face of head means 67. Auger blade means 83 is nested with auger blade means 43; and one end face of head means 87 is aligned with and engages the adjacent end face of head means 47 of anchor 41. As in the case of the engaging end faces of head means 27 and 67, the recesses in the engaging end faces of head means 47 and 87 are aligned and mate to form a circular opening through which shaft 62 of anchor 61 passes.

The shaft of each anchor is therefore received in a recess in the end face of the head means of at least one adjacently positioned anchor, and the head means of each anchor likewise receives the shaft of an adjacent anchor. The end faces of the head means of alternate augers stably engage each other; and the auger blade means of alternate anchors are nested with each other. The length "L" of each head means 7 should be at least as great as the radius of each auger blade means in order to provide sufficient separation between the shafts of alternate augers to facilitate proper nesting of the auger blade means of the augers.

Securing means such as one or more bands or wires of metal or high tensile strength polymeric material are passed around the assembled anchors and fastened snugly to form a stable package. In the illustrated embodiment two straps 18 of high tensile strength polyester are shown passed around the shafts of the assembled anchors adjacent the heads of the anchors and secured by friction welding. Alternatively, the straps could be fastened directly around the heads of the anchors or a single strap could be drawn about the center of the shafts. Steel bands or wires or other known types of packaging materials could be utilized instead of the described polyester bands. When the securing means are drawn around the shafts of the assembled anchors and fastened tightly enough to place the shafts of the outermost anchors of the assembly under slight lateral tension, the end faces of the heads are urged strongly against each other and an especially stable packaged unit results.

Stable packages of two or more anchors may be produced. The packaging technique of the invention is equally suitable for sets containing either even or odd numbers of anchors. The nesting pattern may be continued for up to twelve or more anchors. Generally packages will contain from 2 to 8 anchors, most usually a set of four anchors, as this is the most frequently required set size.

The foregoing embodiments have been set forth solely to exemplify the invention, and are not intended to be limiting. Modifications of the disclosed embodiments within the scope and spirit of the invention may occur to persons skilled in the art. For example, instead of being semicircular, recesses 16 could be V-shaped or trapezoidal. The heads could take various shapes. Also, a plurality of single-flight auger blades or a single multiflight blade could be secured to each shaft. Accordingly, the scope of the invention is to be limited solely by the scope of the appended claims.

I claim:

1. A package of tie down anchors comprising a plurality of individual tie down anchors each comprising shaft means, auger blade means secured to said shaft means adjacent one end thereof and head means secured to the other end of said shaft means, said anchors being assembled in interlocking, nesting relation alongside each other with the shaft means of each anchor adjacent the auger blade means thereof being received in a recess formed in the head means of an adjacent anchor, and strap means for holding said anchors in position with respect to each other.

2. A package according to claim 1, wherein the head means of each anchor comprises a U-shaped member with the bottom of the U secured to the shaft means and the arms of the U extending away from said shaft means generally parallel thereto, at least one end face of said U-shaped member being provided with a recess for receiving the shaft of an adjacently disposed anchor.

3. A package according to claim 2, wherein the length of the head means of each anchor is at least as great as the radius of the auger blade means.

4. A package according to claim 2, wherein at least one pair of aligned apertures is formed through the arms of said U-shaped member for receiving a mounting bolt for a tie down strap or cable.

5. A package according to claim 4, wherein two pair of aligned apertures are formed through the arms of said U-shaped member.

6. A package according to claim 5, wherein the head means of each anchor is eccentrically positioned with respect to the shaft means to which it is secured, and one pair of said apertures is aligned with said shaft means whereby a single mounting bolt may be utilized to fasten a cable or strap to said anchor without exerting a torsional force on the head means of said anchor.

7. A package according to claim 2, wherein both end faces of said U-shaped member are provided with a recess for receiving the shaft of an adjacently disposed anchor.

8. A package according to claim 1 or 7 wherein each said recess is a semicircular depression having a radius substantially equal to the radius of said shaft means.

9. A package according to claim 1, wherein the shaft means of each said anchor is generally parallel to the shaft means of each other anchor.

10. A package according to claim 1, wherein each auger blade means comprises a single-flight, helical member formed from a bent circular plate with a central aperture and a radial split and welded to said shaft means.

11. A package according to claim 1, wherein each auger blade means is provided with sharpened leading and trailing edges.

12. A package according to claim 1, wherein the auger blade means and the head means of each anchor are welded to the shaft means of the anchor.

13. A package according to claim 1, wherein the end of the shaft means adjacent the auger blade means of each anchor is pointed by cutting it off at an angle with respect to the axis of the shaft means.

14. A package according to claim 4, further comprising means for preventing rotation of a mounting bolt extended through said pair of aligned apertures.

15. A package according to claim 14, wherein said rotation preventing means comprises a polygonal depression in the side of one of the arms of the U-shaped member around the aperture therethrough adapted to positively engage the polygonal head of a mounting bolt extended through said pair of apertures when the bolt is tightened.

16. A package according to claim 1, wherein said strap means comprises a steel strap.

17. A package according to claim 1, wherein said strap means comprises a high tensile strength polyester band.

18. A package according to claim 1, comprising from 2 to 8 anchors.

19. A package according to claim 1, wherein the shaft means of a first anchor is received in a recess formed in a radial end face of the head means of a second anchor and said radial end face of said second anchor matingly engages a radial end face of the head means of a third anchor.

20. A package according to claim 19, wherein a recess is formed in said matingly engaging radial end face of the head of said third anchor which recess mates with said recess formed in a radial end face of the head of said second anchor to form an aperture through which the shaft means of said first anchor extends.

21. A package according to claim 20, wherein the radius of the aperture formed by the mating recesses in the head means of said second and third anchors is substantially equal to the radius of the shaft means of said first anchor, and the shaft means of said first anchor is firmly clamped between the head means of said second and third anchors.

22. A package according to claim 19, wherein the auger blade means of said second and third anchors overlap and nest with each other.

23. A package according to claim 1, wherein said strap means comprises a single strap disposed around the shaft means of all anchors in the package, and said single strap is tightened to place the shaft means of the outermost anchors under lateral tension.

24. A package of tie down anchors comprising first, second, third and fourth anchors each comprising a shaft, an auger blade secured to said shaft adjacent one end thereof and a head secured to the other end of said shaft and having a pair of recesses formed in opposed radially facing end faces of said head; said second anchor being disposed alongside said first anchor with the shaft of said second anchor adjacent the blade thereof received in one of the recesses in the head of said first anchor and the shaft of said first anchor adjacent the blade thereof received in one of the recesses in the head of said second anchor, said third anchor being disposed alongside said second anchor with the shaft of said third anchor adjacent the blade thereof received in the other recess in the head of said second anchor and the head of said third anchor stably engaging the head of said first anchor with one of the recesses in the head of the third anchor matingly aligned with said one recess in the head of the first anchor to define an aperture through which the shaft of said second anchor extends; said fourth anchor being disposed alongside said third anchor with the shaft of said fourth anchor adjacent the blade thereof received in the other recess in the head of said third anchor and the head of said fourth anchor stably engaging the head of said second anchor with one of the recesses in the head of said fourth anchor matingly aligned with said other recesses in the head of said second anchor to define an aperture through which the shaft of said third anchor extends, and strap means for holding said anchors in position with respect to each other.

25. A stably nestable tie down anchor comprising shaft means, auger blade means secured to said shaft means adjacent one end thereof and head means secured to the other end of said shaft means, said head means being provided with at least one recess for receiving the shaft means of a second tie down anchor and having a radially facing surface for stably engaging the head means of a third tie down anchor, said recess being formed in said radially facing surface of said head means.

26. An anchor according to claim 25, wherein the head means of each anchor comprising a U-shaped member with the bottom of the U secured to the said other end of said shaft means and the arms of the U extending away from said shaft means generally parallel thereto, said radially facing surface comprising one of the end faces of said U-shaped member.

27. An anchor according to claim 26, wherein the length of the head means of each anchor is at least as great as the radius of the auger blade means.

28. An anchor according to claim 26, wherein at least one pair of aligned apertures is formed through the arms of said U-shaped member for receiving a mounting bolt for a tie down strap or cable.

29. An anchor according to claim 28, wherein two pair of aligned apertures are formed through the arms of said U-shaped member.

30. An anchor according to claim 29, wherein the head means of each anchor is eccentrically positioned with respect to the shaft means to which it is secured, and one pair of said apertures is aligned with said shaft means, whereby a single mounting bolt may be utilized to fasten a cable or strap to said anchor without exerting a torsional force on the head means of said anchor.

31. An anchor according to claim 26, wherein both end faces of said U-shaped member are provided with a recess for receiving the shaft of an adjacently disposed anchor.

32. An anchor according to claim 25 or 31, wherein each said recess is a semicircular depression having a radius substantially equal to the radius of said shaft means.

33. An anchor according to claim 26, wherein said auger blade means comprises a single-flight helical member formed from a bent circular plate with a central aperture and a radial split and welded to said shaft means.

34. An anchor according to claim 33, wherein said auger blade means is provided with sharpened leading and trailing edges.

35. An anchor according to claim 25, wherein said auger blade means and said head means are welded to said shaft means.

36. An anchor according to claim 25, wherein the end of the shaft means adjacent the auger blade means is pointed by cutting it off at an angle with respect to the axis of the shaft means.

37. An anchor according to claim 29 further comprising means for preventing rotation of a mounting bolt extended through said pair of aligned apertures.

38. An anchor according to claim 37, wherein said rotation preventing means comprises a polygonal depression in the outside of one of the arms of the U-shaped member around the aperture therethrough adapted to positively engage the polygonal head of a mounting bolt extending through said pair of apertures when the bolt is tightened.

* * * * *